US008985895B2

(12) United States Patent
Tian et al.

(10) Patent No.: US 8,985,895 B2
(45) Date of Patent: Mar. 24, 2015

(54) AUXILIARY MEMBER FOR PAVEMENT CONSTRUCTION, CONCRETE SLAB AND METHOD FOR PAVEMENT CONSTRUCTION

(71) Applicants: Research Institute of Highway Ministry of Transport, Beijing (CN); Zhonglu High-Tech Highway Technology (Beijing) Co., Ltd., Beijing (CN); Guangxi Communications Investment Group Co., Ltd., Nanning (CN)

(72) Inventors: Bo Tian, Beijing (CN); Qin Fu, Nanning (CN); Zhijie Chen, Nanning (CN); Jinde Xie, Beijing (CN); Peng Peng, Beijing (CN); Zuguang Yuan, Nanning (CN); Zhi Fu, Beijing (CN); Zhu Luo, Beijing (CN); Ying Liu, Beijing (CN); Rongguo Hou, Beijing (CN); Dapeng Wang, Beijing (CN); Jiliang Wang, Beijing (CN); Hongfeng Sun, Beijing (CN); Xiuxiong Mo, Beijing (CN); Zhe He, Beijing (CN)

(73) Assignees: Research Institute of Highway Ministry of Transport, Beijing (CN); Zhonglu High-Tech Highway Technology (Beijing) Co., Ltd., Beijing (CN); Guangxi Communications Investment Group Co., Ltd., Nanning (CN)

( * ) Notice: Subject to any disclaimer, the term of this patent is extended or adjusted under 35 U.S.C. 154(b) by 0 days.

(21) Appl. No.: 14/171,638

(22) Filed: Feb. 3, 2014

(65) Prior Publication Data

US 2014/0147203 A1 May 29, 2014

Related U.S. Application Data

(63) Continuation of application No. PCT/CN2012/085465, filed on Nov. 28, 2012.

(30) Foreign Application Priority Data

Feb. 21, 2012 (CN) ..... 2012 1 0041291

(51) Int. Cl.
*E01C 23/10* (2006.01)
*E01C 23/00* (2006.01)

(Continued)

(52) U.S. Cl.
CPC . *E01C 23/00* (2013.01); *E01C 5/06* (2013.01); *E01C 19/52* (2013.01); *E01C 7/00* (2013.01)
USPC ..... 404/73; 404/17; 404/36; 404/78

(58) Field of Classification Search
CPC ..... E01C 5/06; E01C 7/00; E01C 19/52; E01C 23/00
USPC ..... 404/17, 36, 78
See application file for complete search history.

(56) References Cited

U.S. PATENT DOCUMENTS 1,915,032 A * 6/1933 Poulter ..... 404/78
2,007,457 A * 7/1935 Peters ..... 404/108

(Continued)

FOREIGN PATENT DOCUMENTS

CN 1446891 A 10/2003
CN 101570949 A 11/2009

(Continued)

OTHER PUBLICATIONS

International Search Report of International Application No. PCT/CN2012/085465, dated Mar. 7, 2013.

(Continued)

*Primary Examiner* — Raymond W Addie
(74) *Attorney, Agent, or Firm* — J.C. Patents

(57) ABSTRACT

An auxiliary member for pavement construction, including: a cylinder, a base plate and a leveling bolt; the cylinder includes a first cylinder part and a second cylinder part which are connected and communicated with each other, the first cylinder part is provided with a sling installing member and a slurry inlet, bottom of the second cylinder part is connected with the base plate, the base plate is provided with a bolt extending hole and multiple slurry discharging holes which are communicated with the inner cavity of the second cylinder part, the leveling bolt includes a bolt head and a screw, the screw extends through the bolt extending hole, the bolt head is arranged in the second cylinder part and the bolt head is smaller than the inner diameter of the second cylinder part. The present invention further provides a concrete slab and a method for pavement construction.

20 Claims, 4 Drawing Sheets

(51) Int. Cl.

| | |
|---|---|
| ***E01C 5/06*** | (2006.01) |
| ***E01C 19/52*** | (2006.01) |
| ***E01C 7/00*** | (2006.01) |

(56) References Cited

U.S. PATENT DOCUMENTS

| | | | | | |
|---|---|---|---|---|---|
| 2,367,146 | A | * | 1/1945 | Siebs | 264/34 |
| 2,662,343 | A | * | 12/1953 | Rice | 47/33 |
| 4,240,995 | A | * | 12/1980 | Milne | 264/36.2 |
| 4,567,708 | A | * | 2/1986 | Haekkinen | 52/742.13 |
| 4,583,879 | A | * | 4/1986 | Hofman | 404/73 |
| 4,962,913 | A | * | 10/1990 | Stewart | 254/269 |
| 5,772,183 | A | * | 6/1998 | Sears | 254/324 |
| 6,558,071 | B1 | * | 5/2003 | Sproules | 404/78 |
| 6,827,521 | B2 | * | 12/2004 | Sproules | 404/34 |
| 8,186,907 | B1 | * | 5/2012 | Asplin | 404/78 |
| 8,459,897 | B1 | * | 6/2013 | Knapp | 404/78 |

FOREIGN PATENT DOCUMENTS

| | | | |
|---|---|---|---|
| CN | 101748674 | A | 6/2010 |
| CN | 102587265 | A | 7/2012 |
| CN | 202577123 | U | 12/2012 |
| DE | 201 17 556 | U1 | 2/2002 |
| GB | 258729 | | 9/1926 |
| JP | 09-100503 | | 4/1997 |

OTHER PUBLICATIONS

Chinese First Examination Report of Chinese Application No. 201210041291.X, dated Feb. 21, 2012.

* cited by examiner

AUXILIARY MEMBER FOR PAVEMENT CONSTRUCTION, CONCRETE SLAB AND METHOD FOR PAVEMENT CONSTRUCTION

CROSS-REFERENCE TO RELATED APPLICATIONS

This application is a continuation of International Patent Application No. PCT/CN2012/085465, filed on Nov. 28, 2012, which claims priority to Chinese Patent Application No. 201210041291.X, filed on Feb. 21, 2012, both of which are hereby incorporated by reference in their entireties.

FIELD OF THE TECHNOLOGY

The present invention relates to highway engineering technologies and, in particular relates to an auxiliary member for pavement construction, a concrete slab and a method for pavement construction.

BACKGROUND

In order to ensure the road to be open to traffic quickly after the pavement repair construction is finished, a rapid maintenance technology, i.e. precast assembling rapid repair technology, is adopted in cement concrete pavement maintenance, which is to manufacture the concrete slab in precast stage at casting yard, and assemble and process each part of the concrete slab at construction site.

Specifically, during the construction process, in order to ensure the evenness of the pavement after assembling, first excavating the pavement which needs to be repaired, and then leveling the pavement area after being cleaned; generally subgrade leveling method is adopted, for example, common subgrade leveling methods mainly are: dry-mixed mortar leveling, self-leveling mortar leveling, cold asphalt admixture leveling etc, that is to level the road subgrade after excavation by using the plastic property of these materials. After the subgrade is leveled, the precast concrete slab is hoisted to the leveled excavation area of the pavement by using hoisting equipment, so that the pavement construction is completed.

However, there are many defects in the above pavement construction method: in one aspect, in order to ensure the evenness of the pavement after assembling, it is needed to adjust the subgrade repeatedly, which will increase construction difficulty and the efficiency is very low; in another aspect, the excavation area after being leveled may still have regions that are not tightly jointed with the assembled slab, which causes that the assembled concrete slab has void area at the bottom, resulting in poor pavement durability. Above all, the method for pavement construction in prior art is of low efficiency and poor quality.

SUMMARY

The first aspect of the present invention provides an auxiliary member for pavement construction, so as to increase the speed and improve the quality of pavement construction.

The second aspect of the present invention provides a concrete slab, so as to increase the speed and improve the quality of pavement construction.

The third aspect of the present invention provides a method for pavement construction, so as to increase the speed and improve the quality of pavement construction.

The auxiliary member for pavement construction provided by the present invention includes: a cylinder, a base plate and a leveling bolt; the cylinder includes a first cylinder part and a second cylinder part which are connected and communicated with each other, the first cylinder part is provided with a sling installing member and a slurry inlet, the bottom of the second cylinder part is connected with the base plate; the base plate is provided with a bolt extending hole and a slurry discharging hole which are communicated with the inner cavity of the second cylinder part; the leveling bolt includes a bolt head and a screw, the screw extends through the bolt extending hole, the bolt head is disposed in the second cylinder part, and the bolt head is smaller than the inner diameter of the second cylinder part.

The concrete slab provided by the present invention is provided with the auxiliary member for pavement construction of the present invention; the concrete slab includes a top surface facing the pavement and a bottom surface facing the road subgrade, the cylinder of the auxiliary member for pavement construction is embeddedly fixed in the concrete slab, the slurry inlet is exposed from the top surface, and the slurry discharging hole is exposed from the bottom surface or from a top surface of a slurry flowing groove reserved at the bottom of the concrete slab.

The method for pavement construction provided by the present invention includes: assembling a sling, which is configured to hoist the concrete slab, with the sling installing member of the cylinder of the auxiliary member for pavement construction, so as to fix the sling with the auxiliary member for pavement construction; hoisting the concrete slab to the pavement construction area by the sling, and placing the concrete slab in the road subgrade of the pavement construction area; adjusting the leveling bolt of the auxiliary member for pavement construction, so as to level the pavement where the top surface of the concrete slab is located; injecting the slurry through the first cylinder part of the cylinder, so as to make the slurry flow through the second cylinder part and the slurry discharging hole which are communicated with each other in turn, and fill the void area between the bottom surface of the concrete slab and the road subgrade.

The technical effect of the auxiliary member for pavement construction provided by the present invention is: through providing the leveling bolt, the evenness of the pavement can be guaranteed by adjusting the leveling bolt, compared to the method of laying leveling layer in prior art, the method of adjusting the bolt is more rapid, easy and convenient, which can improve the efficiency of pavement construction significantly; in addition, through providing the slurry discharging hole, the slurry can be filled into the void area of the bottom of the concrete slab through the cylinder and the slurry discharging hole, which guarantees a firm combination of the bottom of the concrete slab and the road subgrade, so as to ensure the durability of the pavement and improve the quality of the pavement.

The technical effect of the concrete slab provided by the present invention is: through providing the auxiliary member for pavement construction in the concrete slab and providing the leveling bolt in the auxiliary member for pavement construction, the evenness of the pavement can be guaranteed by adjusting the leveling bolt, compared to the method of laying leveling layer in prior art, the method of adjusting the bolt is more rapid, easy and convenient, which can improve the efficiency of pavement construction significantly; in addition, through providing the slurry discharging hole, the slurry can be filled into the void area of the bottom of the concrete slab through the cylinder and the slurry discharging hole, which guarantees a firm combination of the bottom of the concrete slab and the road subgrade, so as to ensure the durability of the pavement and improve the quality of the pavement.

The technical effect of the method for pavement construction provided by the present invention is: the evenness of the pavement can be guaranteed by adjusting the leveling bolt through providing the leveling bolt, compared to the method of laying leveling layer in prior art, the method of adjusting the bolt is more rapid, easy and convenient, which can improve the efficiency of pavement construction significantly; in addition, through providing the slurry discharging hole, the slurry can be filled into the void area of the bottom of the concrete slab through the cylinder and the slurry discharging hole, which guarantees a firm combination of the bottom of the concrete slab and the road subgrade, so as to ensure the durability of the pavement and improve the quality of the pavement.

DETAILED DESCRIPTION

Embodiment 1

Figure 1:
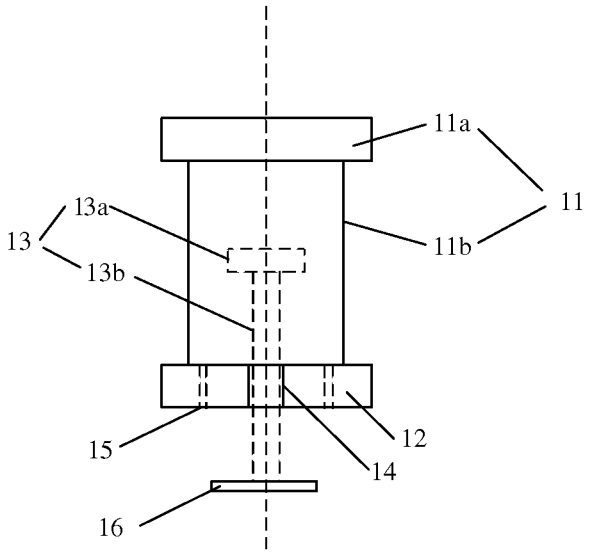
FIG. 1 is a side view of an auxiliary member for pavement construction provided by an embodiment of the present invention.
Figure 2:
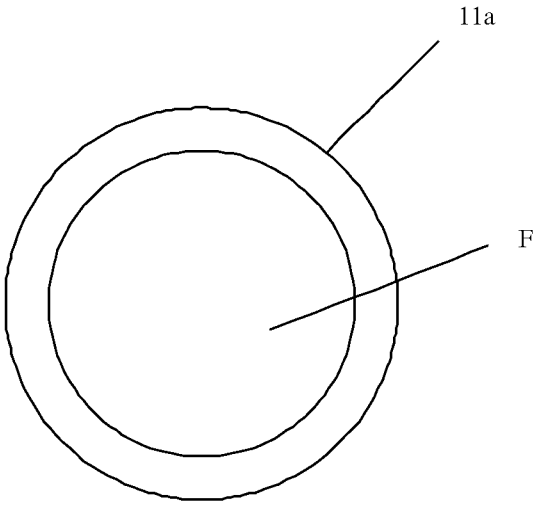
FIG. 2 is a top view of the auxiliary member for pavement construction provided by the embodiment of the present invention.
Figure 3:
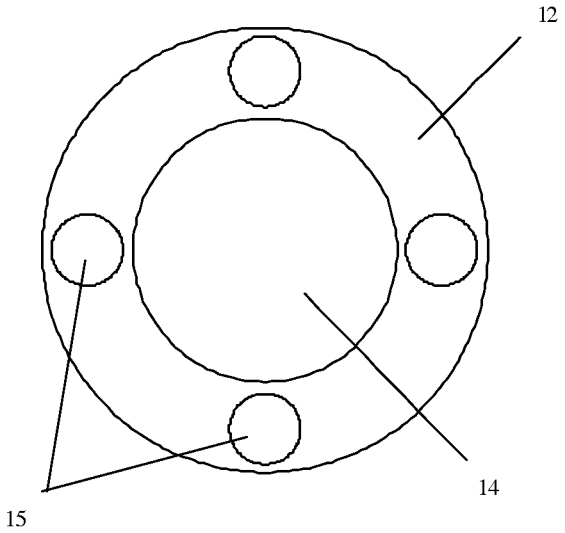
FIG. 3 is a bottom view of the auxiliary member for pavement construction provided by the embodiment of the present invention.

FIG. 1 is a side view of an auxiliary member for pavement construction provided by an embodiment of the present invention, FIG. 2 is a top view of the auxiliary member for pavement construction provided by the embodiment of the present invention, FIG. 3 is a bottom view of the auxiliary member for pavement construction provided by the embodiment of the present invention; where, the leveling bolt is not shown in FIG. 2 and FIG. 3.

As shown in FIG. 1 to FIG. 3, the auxiliary member for pavement construction of this embodiment includes a cylinder 11, a base plate 12 and a leveling bolt 13. Where, the cylinder 11 includes a first cylinder part 11*a* and a second cylinder part 11*b*, the first cylinder part 11*a* and the second cylinder part 11*b* are connected and communicated with each other; the first cylinder part 11*a* is provided with a sling installing member, the bottom of the second cylinder part 11*b* is connected with the base plate 12. It should be noted that, the first cylinder part and the second cylinder part are not limited to two cylinder parts, but only represent that the cylinder 11 includes two regions (or called two parts), one region is provided with the sling installing member, the other region is connected with the base plate; that is, the first cylinder part and the second cylinder part are only names of the regions, but are not intended to limit that how many cylinders are included in the cylinder 11. For example, in specific implementations, the first cylinder part and the second cylinder part can be two cylinders, or can also be two parts of a same cylinder; when the first cylinder part and the second cylinder part are two cylinders, the outer diameters of the two cylinders can be the same or not, which is not limited here, as long as the two cylinders are communicated with each other.

The first cylinder part 11*a* is provided with a sling installing member, the sling installing member is a structure for installing the sling, for example, when the sling is a hoisting ring, the sling installing member can be the inner thread provided on the inner wall of the first cylinder part, the hoisting ring can be installed on the inner thread, the hoisting ring can be fixed on the auxiliary member for pavement construction through fitting assembling of the hoisting ring and the inner thread, such that the equipment with the auxiliary member for pavement construction can be hoisted by a hoisting equipment which is connected with the hoisting ring.

Where, the base plate 12 is provided with a bolt extending hole 14 and a slurry discharging hole 15, the bolt extending hole 14 and the slurry discharging hole 15 are communicated with the second cylinder part 11*b*. The leveling bolt 13 includes a bolt head 13*a* and a screw 13*b*, the screw 13*b* extends through the bolt extending hole 14 on the base plate 12, the bolt extending hole 14 is provided with inner thread, the bolt extending hole 14 and the screw 13*b* constitute a screw joint mode, the length of the screw 13*b* which protrudes out of the bolt extending hole 14 can be adjusted through rotating the bolt head 13*a*. The bolt head 13*a* is arranged in the second cylinder part 11*b*, and the bolt head 13*a* is smaller than the inner diameter of the second cylinder part 11*b*, so as to ensure the slurry to flow through the second cylinder part 11*b* and discharge from the slurry discharging hole 15 after being injected from a grouting opening F of the first cylinder part 11*a*.

This embodiment can ensure the evenness of the pavement through adjusting the leveling bolt, when the pavement is uneven, through rotating the bolt head of the leveling bolt to change the length of the screw of the bolt which protrudes out of the base plate, the altitude difference between the adjacent slabs or between the new pavement and the old pavement can be eliminated by utilizing the supporting effect of the protruded screw, however, in prior art, the altitude difference is filled up through filling mortar, the construction speed thereof is obviously slower than the speed of bolt adjustment, and the construction method thereof is obviously more complicated than the method of bolt adjustment, therefore, compared to the method of laying leveling layer in prior art, the method of bolt adjustment is more rapid, easy and convenient, which can improve the efficiency of pavement construction significantly and the assembling precision of the concrete slabs; in addition, the slurry inlet, the cylinder and the slurry discharging hole can constitute a grouting passage, through grouting the slurry into the grouting passage, the slurry can flow to the void area of the bottom of the concrete slab through the slurry discharging hole, since the leveling bolt supports the top surface of the subgrade to make the pavement even, at this time the slurry can fill up the void area, so as to guarantee a firm combination of the bottom of the concrete slab and the road subgrade, ensure the durability of the pavement and improve the quality of the pavement; in addition, the auxiliary member for pavement construction of this embodiment integrates the sling installing member, the grouting passage and the leveling bolt as one part, three functions of hoisting, grouting and leveling can be achieved by the member, however, in prior art, there is only one sling of a concrete slab for hoisting the concrete slab, the leveling is operated later and the operation is complicated, and there is no grouting operation, therefore, the member of this embodiment can greatly increase the speed and improve the quality of construction compared to the prior art.

Alternatively, please refer to FIG. 3, on the base plate 12, the bolt extending hole 14 can be provided at the central part of the base plate 12, so as to improve the leveling effect of the pavement; there can be multiple slurry discharging holes 15, the slurry discharging holes 15 can be arranged around the bolt extending hole 14, so as to make the slurry well distributed.

Figure 4:
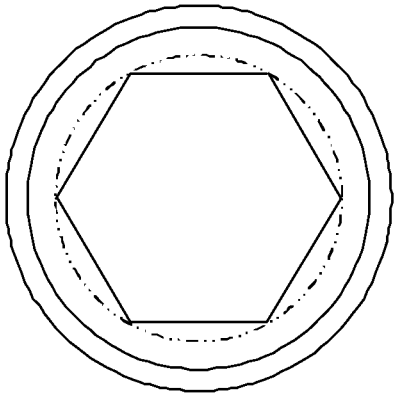
FIG. 4 is a top view of a leveling bolt of the auxiliary member for pavement construction provided by the embodiment of the present invention.

Alternatively, please refer to FIG. 4, FIG. 4 is a top view of a leveling bolt of the auxiliary member for pavement construction provided by the embodiment of the present invention. The leveling bolt of this embodiment can be a hexagon socket head bolt, the bolt head of the hexagon socket head bolt is of hexagonal socket shape, which facilitates applying external force on the bolt.

Alternatively, as shown in FIG. 1, the auxiliary member for pavement construction of this embodiment can further include a spacer 16, the spacer 16 is arranged outside the cylinder 11, and is connected with the top end of the screw 13*b*. Through providing the spacer 16, the subgrades of different conditions can be adapted to, so as to ensure the evenness between the assembling slab and the original pavement, and the pressure suffered by the subgrade when adjusting the height of the leveling bolt can be reduced, so as to avoid a secondary damage to the road subgrade due to the point effect of the screw.

Figure 5:
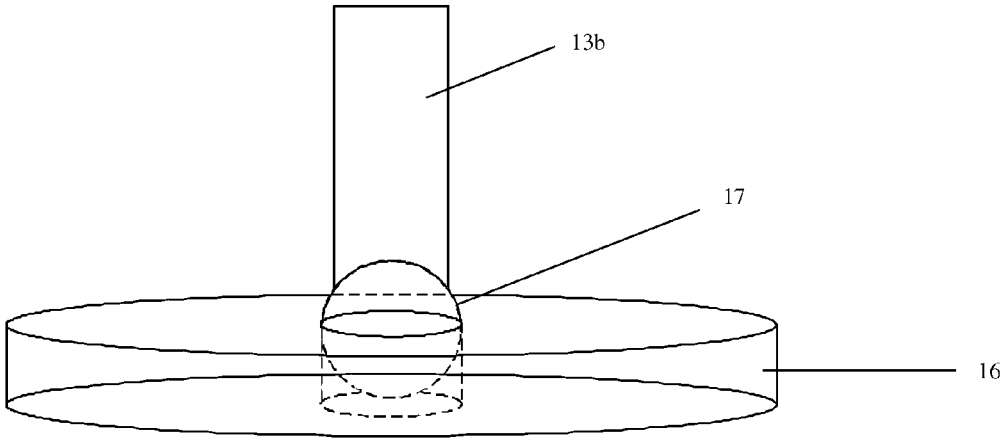
FIG. 5 is a schematic structural diagram of the connection between a leveling bolt and a spacer of the auxiliary member for pavement construction provided by the embodiment of the present invention.

Alternatively, please refer to FIG. 5, FIG. 5 is a schematic structural diagram of the connection between a leveling bolt and a spacer of the auxiliary member for pavement construction provided by the embodiment of the present invention. The screw 13*b* of the leveling bolt and the spacer 16 are connected by a spherical bearing 17; the spherical bearing 17 can adjust the tilting direction of the spacer 16, so as to meet the leveling needs of different directions. For example, in the road subgrade, region G1 is higher than region G2, then the tilting direction of the spacer 16 can be adjusted by the spherical bearing 17, such that the tilt of the spacer 16 can compensate the altitude difference between region G1 and region G2, and finally make the pavement even.

Alternatively, the cylinder 11 and the base plate 12 of the auxiliary member for pavement construction can be in weld connection or integrated as one part; the first cylinder part 11*a* and the second cylinder part 11*b* can also be in weld connection or integrated as one part, in specific implementation, it is a free choice, which is not limited. For example, as shown in FIG. 1, the auxiliary member for pavement construction of this embodiment is of a dumbbell-shape, both of the cylinder and the base plate can be steel pipes; the first cylinder part, the second cylinder part and the base plate are three separate parts, and are in weld connection.

The method of application of the auxiliary member for pavement construction will be illustrated in an example that the auxiliary member for pavement construction of this embodiment is used in precast assembling rapid repair technology, but in specific implementation, the auxiliary member for pavement construction is not limited to be applied to precast assembling rapid repair technology, and can also be applied in other situations;

First, when precasting the concrete slab, pre-burying the auxiliary member for pavement construction of this embodiment in an appropriate position of the concrete slab; where, the pre-burying is to place the member in the appropriate position and then inject concrete slurry until the concrete slurry is solidified, which is a conventional construction method; the appropriate position refers to a position in which the entire concrete slab can be hoisted safely and successfully, and the leveling and grouting effect thereof is better; for example, viewing from the top of the concrete slab, finding the quarter lines of the long edge and the short edge of the top surface of the slab respectively (including a quarter line at a quarter position of the corresponding edge, a two quarters line at a two quarters position of the corresponding edge, a three quarters line at a three quarters position of the corresponding edge), the intersection of the quarter line of the long edge and the quarter line of the short edge is the set point, the member can be positioned at the set point (in practical application there may be a deviation), the set position can make the stress of the concrete slab uniform when hoisting, thus the hoisting is easier and the concrete slab will not be damaged. Those of ordinary skill in the art can understand, the above quarter line method is an alternative method in specific implementation, which is not limited here, other setting methods can be adopted, as long as the entire concrete slab can be hoisted safely and successfully.

Where, when pre-burying the auxiliary member for pavement construction, the auxiliary member for pavement construction should extend through the top surface and the bottom surface of the concrete slab, the extending through here represents that, the hoisting sling can be installed on the sling installing member of the auxiliary member for pavement construction from the top surface of the concrete slab, and the grouted slurry can discharge to the road subgrade from the bottom surface of the concrete slab; the top surface of the concrete slab is a slab surface facing the pavement, the bottom surface of the concrete slab is a slab surface facing the road subgrade.

Then, assembling the sling, which is configured to hoist the concrete slab, for example, a hoisting ring, with the sling installing member of the cylinder of the auxiliary member for pavement construction, so as to fix the sling with the auxiliary member for pavement construction; for example, the sling installing member is of inner thread, the hoisting ring has outer thread, by screwing the hoisting ring on the sling installing member, the hoisting ring can be fixed with the concrete slab. Hooking the hoisting ring by a hoisting equipment, and hoisting the concrete slab to the pavement construction area, placing the concrete slab in the road subgrade of the pavement construction area, that is to place the concrete slab in the excavation area of the pavement under construction.

Then, adjusting the leveling bolt of the auxiliary member for pavement construction, which can be achieved by having an adjusting member extend into the member for pavement construction from the top end of the first cylinder part of the auxiliary member for pavement construction, and screwing the bolt head of the leveling bolt to adjust the leveling bolt. Through adjusting the extending length of the screw, the altitude difference between the concrete slab and the original pavement is compensated, so as to ensure the evenness of the pavement where the top surface of the concrete slab is positioned and meet the evenness requirement between the concrete slabs and between the concrete slab and the original pavement.

At last, after the adjustment, the pavement is even; at this time, the cylinder and the slurry discharging hole of the auxiliary member for pavement construction of this embodiment can constitute a grouting passage, the slurry is grouted into the first cylinder part of the cylinder, and flows in turn through the second cylinder part and the slurry discharging hole which are communicated with each other, and fills up the void area between the bottom surface of the concrete slab and the road subgrade, so as to achieve a firm combination of the bottom of the concrete slab and the road subgrade and ensure the durability of the pavement.

Additionally, a groove cutting process can be performed to the concrete slab by a grooving machine, so as to ensure the skid resistance requirement of the pavement; through grouting joint sealing material into the gaps between the concrete slabs and between the concrete slab and the original pavement, the construction of gap sealing is completed; and the road can be open to traffic after the joint sealing material is solidified.

Alternatively, a further process of grinding by a griding machine or milling and planing by a milling machine can be applied to the uneven parts between the concrete slabs and between the concrete slab and the original pavement, so as to further ensure the evenness of the pavement.

For the auxiliary member for pavement construction provided by this embodiment, through providing the leveling bolt, the leveling bolt can be adjusted to ensure the evenness of the pavement, compared to the method of laying aggregate in prior art, the method of adjusting the bolt is more rapid, easy and convenient, which can improve the efficiency of pavement construction significantly; in addition, through providing the slurry discharging hole, the slurry can be filled into the void area of the bottom of the concrete slab through the cylinder and the slurry discharging hole, which guarantees a firm combination of the bottom of the concrete slab and the road subgrade, so as to ensure the durability of the pavement and improve the quality of the pavement.

Embodiment 2

Figure 6:
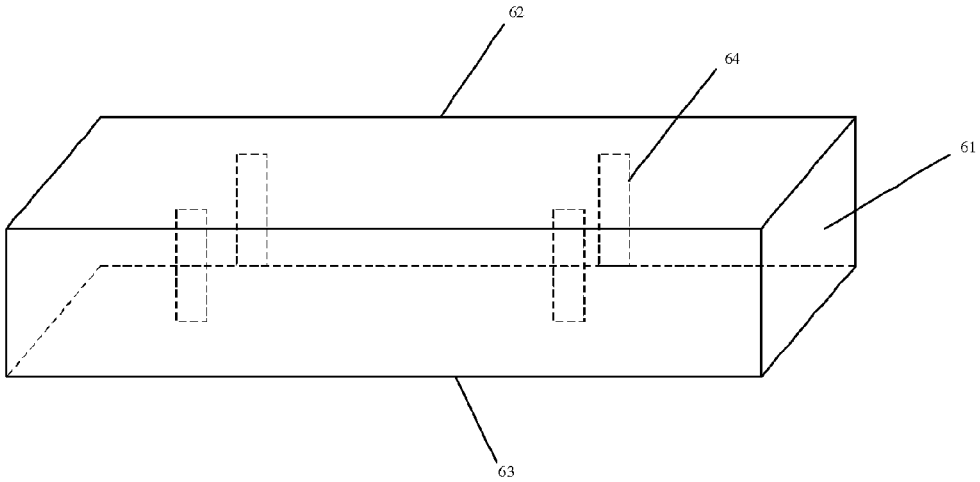
FIG. 6 is a schematic structural diagram of a concrete slab provided by an embodiment of the present invention.

FIG. 6 is a schematic structural diagram of a concrete slab provided by an embodiment of the present invention, as shown in FIG. 6, the concrete slab is provided with the auxiliary member for pavement construction according to any one of the embodiments.

Where, the concrete slab 61 includes a top surface 62 and a bottom surface 63, after the construction, the top surface 62 is facing to the pavement, the bottom surface 63 is facing to the road subgrade; the cylinder of the auxiliary member for pavement construction is embeddedly fixed in the concrete slab. The auxiliary member for pavement construction 64 (The auxiliary member for pavement construction shown in FIG. 6 is a brief view, for the detailed structure of the auxiliary member, please refer to the embodiment of the auxiliary member for pavement construction of the present invention) is pre-buried in the concrete slab when the concrete slab is precast. Where, the auxiliary member is pre-buried in an appropriate position of the concrete slab, the appropriate position refers to a position in which the entire concrete slab can be hoisted safely and successfully, and the leveling and grouting effect thereof is better. In addition, when pre-burying the auxiliary member for pavement construction, the auxiliary member for pavement construction should extend through the top surface and the bottom surface of the concrete slab, the extending through here represents that, the slurry inlet of the member is exposed from the top surface of the concrete slab, the slurry discharging hole of the member is exposed from the bottom surface or a top surface of a slurry flowing groove reserved at the bottom of the concrete slab, the sling can be installed on the sling installing member of the auxiliary member for pavement construction from the top surface of the concrete slab, and the grouted slurry can discharge to the road subgrade from the bottom surface of the concrete slab. Preferably, the top surface of the member and the top surface of the concrete slab is parallel and level so as to ensure the evenness of the pavement; the bottom surface of the base plate of the member can be parallel and level with the bottom surface of the concrete slab, or can be retracted from the bottom surface of the concrete slab, that is not parallel and level.

During pavement construction, the sling is assembled and fixed with the sling installing member of the cylinder of the auxiliary member for pavement construction, such that the sling can hoist the concrete slab to the pavement construction area; in addition, the leveling bolt of the auxiliary member for pavement construction in the concrete slab can be adjusted to ensure the evenness of the pavement where the top surface of the concrete is positioned; at last, the slurry is grouted into the auxiliary member for pavement construction of the concrete slab, and flows out of the slurry discharging hole, and fills up the void area between the bottom surface of the concrete slab and the road subgrade.

For the concrete slab provided by this embodiment, through providing the auxiliary member for pavement construction in the concrete slab, and providing the leveling bolt in the auxiliary member for pavement construction, the evenness of the pavement can be ensured by adjusting the leveling bolt, compared to the method of laying leveling layer in prior art, the method of adjusting the bolt is more rapid, easy and convenient, which can improve the efficiency of pavement construction significantly; in addition, through providing the slurry discharging hole, the slurry can be filled into the void area of the bottom of the concrete slab through the cylinder and the slurry discharging hole, which guarantees a firm combination of the bottom of the concrete slab and the road subgrade, so as to ensure the durability of the pavement and improve the quality of the pavement.

Embodiment 3

Figure 7:
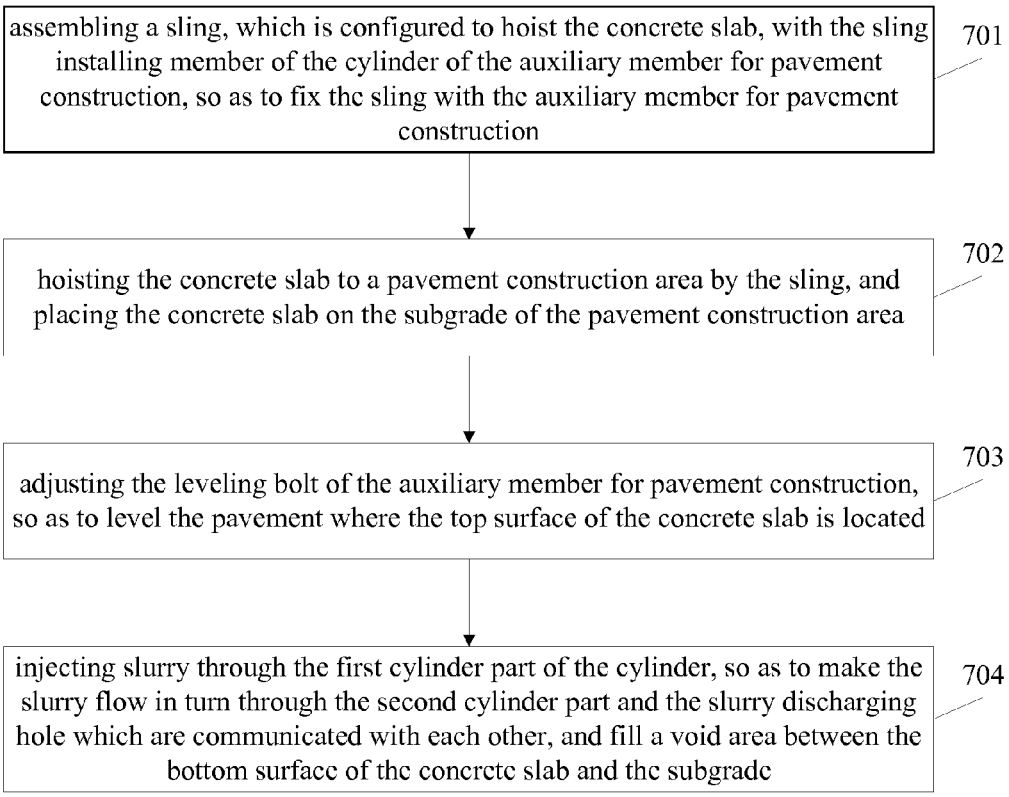
FIG. 7 is a flow diagram of a method for pavement construction provided by an embodiment of the present invention.

FIG. 7 is a flow diagram of a method for pavement construction provided by an embodiment of the present invention, the method of this embodiment can be executed by the auxiliary member for pavement construction provided by any one of the embodiments of the present invention, this embodiment briefly illustrates the method, its detailed principle can be referred to the embodiment of the auxiliary member for pavement construction of the present invention; in addition, the steps 701-704 are only example of each action and will not limit the executing order, which can be rescheduled according to practical construction situation.

As shown in FIG. 7, the method can includes:

701, assembling a sling, which is configured to hoist the concrete slab, with the sling installing member of the cylinder of the auxiliary member for pavement construction, so as to fix the sling with the auxiliary member for pavement construction;

702, hoisting the concrete slab to the pavement construction area by the sling, and placing the concrete slab in the road subgrade of the pavement construction area;

703, adjusting the leveling bolt of the auxiliary member for pavement construction, so as to level the pavement where the top surface of the concrete slab is located;

704, injecting the slurry through the first cylinder part of the cylinder, so as to make the slurry flow through the second cylinder part and the slurry discharging hole which are communicated with each other in turn, and fill the void area between the bottom surface of the concrete slab and the road subgrade.

Additionally, a groove cutting process can be performed to the concrete slab by a grooving machine, so as to ensure the skid resistance requirement of the pavement; through grouting joint sealing material into the gaps between the concrete slabs and between the concrete slab and the original pavement, the construction of gap sealing is completed; and the road can be open to traffic after the joint sealing material is solidified.

Alternatively, a further process of grinding by a griding machine or milling and planing by a milling machine can be applied to the uneven parts between the concrete slabs and between the concrete slab and the original pavement, so as to further ensure the evenness of the pavement.

For the method for pavement construction of this embodiment, through providing the leveling bolt, the leveling bolt can be adjusted to ensure the evenness of the pavement, compared to the method of laying aggregate in prior art, the method of adjusting the bolt is more rapid, easy and convenient, which can improve the efficiency of pavement construction significantly; through providing the slurry discharging hole, the slurry can be filled into the void area of the bottom of the concrete slab through the cylinder and the slurry discharging hole, which guarantees a firm combination of the bottom of the concrete slab and the road subgrade, so as to ensure the durability of the pavement and improve the quality of the pavement.

Finally, it should be noted that the above embodiments are merely provided for describing the technical solutions of the present invention, but not intended to limit the present invention. It should be understood by those of ordinary skill in the art that although the present invention has been described in detail with reference to the foregoing embodiments, modifications can be made to the technical solutions described in the foregoing embodiments, or equivalent replacements can be made to some of or all of the technical features in the technical solutions, as long as such modifications or replacements do not cause the essence of corresponding technical solutions to depart from the scope of the present invention.

The invention claimed is:

1. An auxiliary member for pavement construction, characterized by comprising: a cylinder, a base plate and a leveling bolt;

the cylinder comprises a first cylinder part and a second cylinder part which are connected and communicated with each other, the first cylinder part is provided with a sling installing member and a slurry inlet, the bottom of the second cylinder part is connected with the base plate;

the base plate is provided with a bolt extending hole and a slurry discharging hole which are communicated with an inner cavity of the second cylinder part;

the leveling bolt comprises a bolt head and a screw, the screw extends through the bolt extending hole, the bolt head is arranged in the second cylinder part, and the bolt head is smaller than an inner diameter of the second cylinder part.

2. The auxiliary member for pavement construction according to claim 1, wherein, the sling installing member is internal thread provided on an inner wall of the first cylinder part.

3. The auxiliary member for pavement construction according to claim 1, wherein, the bolt extending hole is provided on a central part of the base plate, multiple slurry discharging holes are distributed around the bolt extending hole.

4. The auxiliary member for pavement construction according to claim 1, wherein, the leveling bolt is a hexagon socket head bolt.

5. The auxiliary member for pavement construction according to claim 1, further comprising a spacer, the spacer is provided outside the cylinder, and is connected with a top end of the screw.

6. The auxiliary member for pavement construction according to claim 3, further comprising a spacer, the spacer is provided outside the cylinder, and is connected with a top end of the screw.

7. The auxiliary member for pavement construction according to claim 5, wherein, the screw and the spacer are connected by a spherical bearing.

8. The auxiliary member for pavement construction according to claim 6, wherein, the screw and the spacer are connected by a spherical bearing.

9. The auxiliary member for pavement construction according to claim 1, wherein, the cylinder and the base plate are in weld connection or integrated as one part.

10. The auxiliary member for pavement construction according to claim 1, wherein, the first cylinder part and the second cylinder part of the cylinder are in weld connection or integrated as one part.

11. A concrete slab, wherein, the concrete slab is provided with the auxiliary member for pavement construction according to claim 1;

the concrete slab comprises a top surface facing pavement and a bottom surface facing a subgrade, the cylinder of the auxiliary member for pavement construction is embeddedly fixed in the concrete slab, and the slurry inlet is exposed from the top surface, the slurry discharging hole is exposed from the bottom surface or a top surface of a slurry flowing groove reserved at the bottom of the concrete slab.

12. A concrete slab, wherein, the concrete slab is provided with the auxiliary member for pavement construction according to claim 5;

the concrete slab comprises a top surface facing pavement and a bottom surface facing a subgrade, the cylinder of the auxiliary member for pavement construction is embeddedly fixed in the concrete slab, and the slurry inlet is exposed from the top surface, the slurry discharging hole is exposed from the bottom surface or a top surface of a slurry flowing groove reserved at the bottom of the concrete slab.

13. A concrete slab, wherein, the concrete slab is provided with the auxiliary member for pavement construction according to claim 6;

the concrete slab comprises a top surface facing pavement and a bottom surface facing a subgrade, the cylinder of the auxiliary member for pavement construction is embeddedly fixed in the concrete slab, and the slurry inlet is exposed from the top surface, the slurry discharging hole is exposed from the bottom surface or a top surface of a slurry flowing groove reserved at the bottom of the concrete slab.

14. A concrete slab, wherein, the concrete slab is provided with the auxiliary member for pavement construction according to claim 7;

the concrete slab comprises a top surface facing pavement and a bottom surface facing a subgrade, the cylinder of the auxiliary member for pavement construction is embeddedly fixed in the concrete slab, and the slurry inlet is exposed from the top surface, the slurry discharging hole is exposed from the bottom surface or a top surface of a slurry flowing groove reserved at the bottom of the concrete slab.

15. A concrete slab, wherein, the concrete slab is provided with the auxiliary member for pavement construction according to claim 8;

the concrete slab comprises a top surface facing pavement and a bottom surface facing a subgrade, the cylinder of the auxiliary member for pavement construction is embeddedly fixed in the concrete slab, and the slurry inlet is exposed from the top surface, the slurry discharging hole is exposed from the bottom surface or a top surface of a slurry flowing groove reserved at the bottom of the concrete slab.

16. A method for pavement construction adopting the concrete slab according to claim 11, characterized by comprising:

assembling a sling, which is configured to hoist the concrete slab, with the sling installing member of the cylinder of the auxiliary member for pavement construction, so as to fix the sling with the auxiliary member for pavement construction;

hoisting the concrete slab to a pavement construction area by the sling, and placing the concrete slab on the subgrade of the pavement construction area;

adjusting the leveling bolt of the auxiliary member for pavement construction, so as to level the pavement where the top surface of the concrete slab is located;

injecting slurry through the first cylinder part of the cylinder, so as to make the slurry flow in turn through the second cylinder part and the slurry discharging hole which are communicated with each other, and fill a void area between the bottom surface of the concrete slab and the subgrade.

17. A method for pavement construction adopting the concrete slab according to claim 12, characterized by comprising:

assembling a sling, which is configured to hoist the concrete slab, with the sling installing member of the cylinder of the auxiliary member for pavement construction, so as to fix the sling with the auxiliary member for pavement construction;

hoisting the concrete slab to a pavement construction area by the sling, and placing the concrete slab on the subgrade of the pavement construction area;

adjusting the leveling bolt of the auxiliary member for pavement construction, so as to level the pavement where the top surface of the concrete slab is located;

injecting slurry through the first cylinder part of the cylinder, so as to make the slurry flow in turn through the second cylinder part and the slurry discharging hole which are communicated with each other, and fill a void area between the bottom surface of the concrete slab and the subgrade.

18. A method for pavement construction adopting the concrete slab according to claim 13, characterized by comprising:

assembling a sling, which is configured to hoist the concrete slab, with the sling installing member of the cylinder of the auxiliary member for pavement construction, so as to fix the sling with the auxiliary member for pavement construction;

hoisting the concrete slab to a pavement construction area by the sling, and placing the concrete slab on the subgrade of the pavement construction area;

adjusting the leveling bolt of the auxiliary member for pavement construction, so as to level the pavement where the top surface of the concrete slab is located;

injecting slurry through the first cylinder part of the cylinder, so as to make the slurry flow in turn through the second cylinder part and the slurry discharging hole which are communicated with each other, and fill a void area between the bottom surface of the concrete slab and the subgrade.

19. A method for pavement construction adopting the concrete slab according to claim 14, characterized by comprising:

assembling a sling, which is configured to hoist the concrete slab, with the sling installing member of the cylinder of the auxiliary member for pavement construction, so as to fix the sling with the auxiliary member for pavement construction;

hoisting the concrete slab to a pavement construction area by the sling, and placing the concrete slab on the subgrade of the pavement construction area;

adjusting the leveling bolt of the auxiliary member for pavement construction, so as to level the pavement where the top surface of the concrete slab is located;

injecting slurry through the first cylinder part of the cylinder, so as to make the slurry flow in turn through the second cylinder part and the slurry discharging hole which are communicated with each other, and fill a void area between the bottom surface of the concrete slab and the subgrade.

20. A method for pavement construction adopting the concrete slab according to claim 15, characterized by comprising:

assembling a sling, which is configured to hoist the concrete slab, with the sling installing member of the cylinder of the auxiliary member for pavement construction, so as to fix the sling with the auxiliary member for pavement construction;

hoisting the concrete slab to a pavement construction area by the sling, and placing the concrete slab on the subgrade of the pavement construction area;

adjusting the leveling bolt of the auxiliary member for pavement construction, so as to level the pavement where the top surface of the concrete slab is located;

injecting slurry through the first cylinder part of the cylinder, so as to make the slurry flow in turn through the second cylinder part and the slurry discharging hole which are communicated with each other, and fill a void area between the bottom surface of the concrete slab and the subgrade.

* * * * *